United States Patent [19]

Dickerson et al.

[11] Patent Number: 4,697,424

[45] Date of Patent: Oct. 6, 1987

[54] POWER GENERATION SYSTEM

[75] Inventors: Clifford Dickerson, Riverside; David Keithly, Los Angeles, both of Calif.

[73] Assignee: Temes Corporation, Los Angeles, Calif.

[21] Appl. No.: 746,469

[22] Filed: Jun. 20, 1985

Related U.S. Application Data

[63] Continuation-in-part of Ser. No. 534,395, Sep. 22, 1983, abandoned, which is a continuation-in-part of Ser. No. 252,314, Apr. 9, 1981, abandoned, which is a continuation-in-part of Ser. No. 81,866, Oct. 4, 1979, abandoned.

[51] Int. Cl.[4] ..... F01K 21/00

[52] U.S. Cl. ..... 60/670; 60/676; 60/721; 219/10.55 R

[58] Field of Search ..... 60/670, 651, 671, 721, 60/676; 219/10.55 R

[56] References Cited

U.S. PATENT DOCUMENTS 3,732,692 5/1973 Norell ..... 60/664

*Primary Examiner*—Allen M. Ostrager

*Attorney, Agent, or Firm*—Lyon & Lyon

[57] ABSTRACT

A system wherein a fluid is agitated by microwave frequency to produce motive power. A fluid, preferably the refrigerant CHClF, is cycled within a closed system. From a holding tank, the fluid, in liquid state, is pumped to a boiler chamber. The fluid is heated to an agitated state therein by a microwave frequency. The fluid, so agitated, is directed through a throttle to a diverter which apportions the flow of fluid between two sets of vanes on a turbine wheel. The exhausted fluid is then returned to the liquid state and to the holding tank. The operation of the system and of the various components may be adapted for monitor and control by computer.

11 Claims, 6 Drawing Figures

POWER GENERATION SYSTEM

This application is a continuation-in-part of U.S. patent application Ser. No. 534,395, filed Sept. 22, 1983, abandoned, which is a continuation-in-part of U.S. patent application Ser. No. 252,314, filed Apr. 9, 1981, abandoned, which is a continuation-in-part of U.S. patent application Ser. No. 081,866, filed Oct. 4, 1979, abandoned, all of which applications are fully incorporated herein by reference.

BACKGROUND OF THE INVENTION

The present invention relates to a power generation system wherein an easily expandable fluid is brought to its expanded state by subjecting the fluid to a microwave frequency. The expanded fluid is diverted to a turbine wheel for conversion of the energy of the fluid to motive power.

With the onset of the decrease in supply, and increase in price, of the traditional fossil fuels, the need for alternative sources of power has intensified. The sun, the wind, the tidal movement of the oceans and the natural heat of the earth are all being cultivated at this time in an attempt to find a cheap, abundant source of energy. While these sources of energy are inexpensive, meaning only that at present no one exacts a duty for sunlight or air, harnessing this power has yet to prove economical. Additionally, one of the main purposes for which the traditional fossil fuels are used is in the powering of automobiles and trucks. Not only has this become increasingly expensive, it is one of the main causes of environmental pollution. The natural sources of energy are patently infeasible via a vis automotive use. Accordingly, in addition to the overall need for alternative sources of energy, there exists a special need for alternative sources which may be utilized in the automotive field. This goal of providing such an alternative to the gas powered engine has been long sought and has proved to be quite elusive.

It is therefore the object of this invention to provide a power generation system which will generate motive power economically and feasibly without polluting the atmosphere.

SUMMARY OF THE INVENTION

The present invention accomplishes the above described objective in a system wherein an easily expanded fluid is caused to expand by subjecting the fluid to microwave frequency. The preferred fluid is a refrigerant commonly known as "FREON 22", available from DuPont and having a chemical composition of $CHClF_2$. The fluid is delivered in monitored amounts to a boiler. The boiler is an elliptical chamber having a longitudinal dimension twice its latitudinal dimension. The fluid within the boiler is radiated with a microwave frequency which is induced to the boiler chamber by means of a magnetron tube which is attached to one end thereof. The fluid, once heated and expanded within the boiler, is released in monitored amounts through throttle means such that it will impinge upon the vanes of a turbine wheel. The turbine wheel has two sets of vanes, a first stage near the center of the turbine wheel and a second stage near the edge of the turbine wheel. A diverter will guide the fluid to either of the sets of vanes or apportion the flow between them. The fluid is then exhausted from the turbine wheel to a condensor where any remaining energy is released, the fluid is cooled and is returned to the holding tank in liquid form.

Although the system may be operated manually, in one embodiment of the invention, all critical functions of the system are monitored and controlled by a central computer, the computer will read input from the various components of the system, assimilate the data and control the operation of the system to obtain optimal efficiency.

DETAILED DESCRIPTION OF THE DRAWINGS

DETAILED DESCRIPTION OF THE PREFERRED EMBODIMENT

Figure 1:
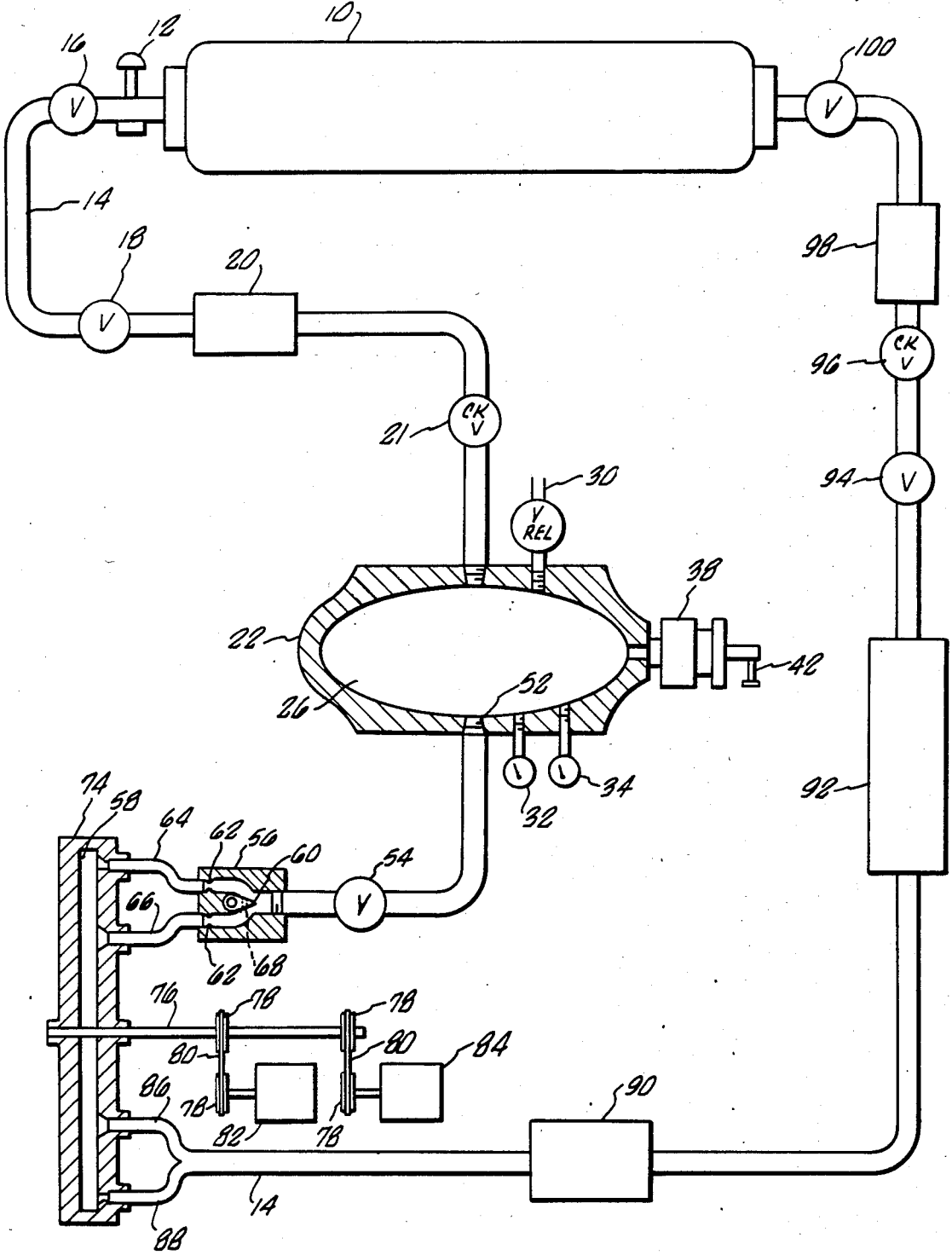
FIG. 1 is a partial schematic showing the general layout and interrelationship of the various components of the system. The boiler and turbine are shown in cross-section.

Referring to FIG. 1, the system comprises a holding tank 10 which is constructed of stainless steel and is of sufficient size to provide storage space for that amount of fluid needed to complete a cycle of this system. The amount of fluid required will depend upon the relative size of the components in this system.

The fluid used in the preferred embodiments of this invention is a refrigerant, commonly known as FREON-22, which has the chemical composition of $CHClF_2$. The refrigerants commonly known as FREON are ideal fluids for this type of system because the fluid is a natural lubricant, it will not readily burn, it has precise working temperature ranges and will cool itself simply by expansion. Additionally, it has a low molecular weight which in turn lends itself to high pressure at low heat and, being similar to water, it will not "wear out" in use. Accordingly, it is a relatively inexpensive medium in that it is not necessary to replace or replenish the fluid at regular intervals. $CHClF_2$ in particular is chosen as the preferred fluid in that its operating range of temperatures suits the needs of this invention.

A filler pipe 12 is provided in the system for charging and venting the refrigerant to and from the system. Piping 14, preferably constructed of stainless steel, provides for the transmission of the fluid to and from the various components in the system. A valve 16, which may be of a standard gate or ball construction, is provided in order that the system, and the various components thereof, may be replaced and repaired without the necessity of bleeding the fluid from the entire system.

A second valve 18 is a one way check valve to preclude the flow of fluid back into the holding tank 10. Next in line is a variable speed pressure pump 20. Pump 20 may be of any conventional type, such as those used in aircraft to pump the hydraulic fluid to run the ailerons. The pump should be electrically powered and be of variable speed so that as the requirements for fluid in the system increases, the pump will have the capability of supplying that amount of fluid. The control for the pump will be regulated by the central computer (not shown in FIG. 1) which will read the demand of the system and increase or decrease the flow of fluids supplied by pump 20 to keep the pressure and volume of fluid constant.

Figure 2:
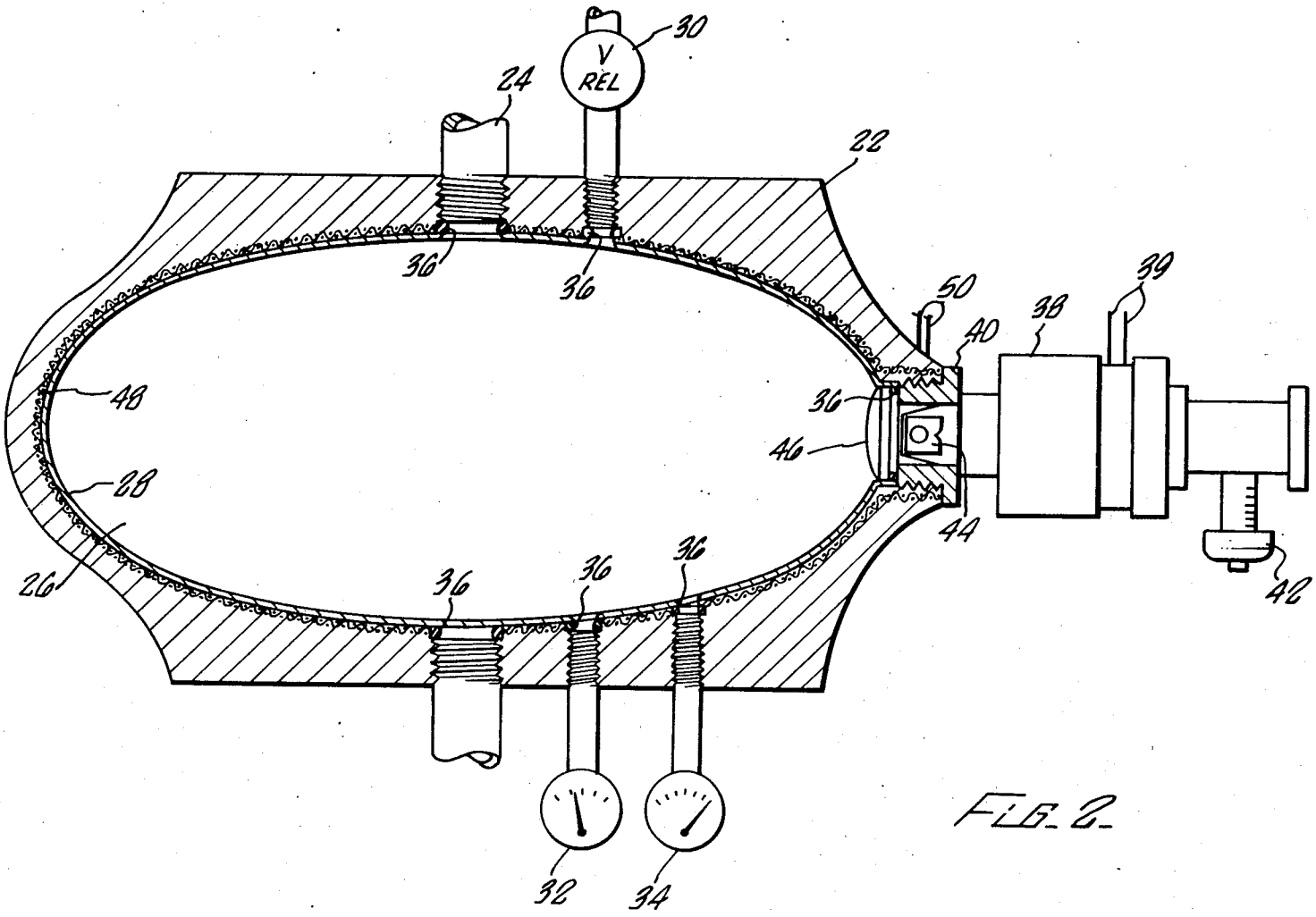
FIG. 2 is an enlargement of the boiler, in crosssection, showing in greater detail its construction, as well as showing the magnetron tube attached thereto.

The fluid, which is still in liquid form, exits from pump 20 and is fed into boiler 22 by means of additional stainless steel pipe 14. A check valve 21 precludes backflow of fluid from boiler 22 to pump 20. Boiler 22 is shown in greater detail in cross-section in FIG. 2. Referring now to that drawing, inlet pipe 24 admits the unagitated fluid into a central elliptical chamber 26. Central chamber 26 has a longitudinal dimension which is exactly twice that of its latitudinal dimension. The boiler is preferably manufactured from aluminum or fiberglass. A stainless steel liner 28 lines the interior of chamber 26. A release valve 30 is provided as a safety valve to preclude the build up of excessive pressure within the chamber 26. Temperature and pressure sensing devices 32 and 34 respectively, are also provided to monitor the temperature and pressure of the fluid within the chamber 26. It will be noted that neoprene-carbon seals 36 are used about each opening into the chamber 26.

A magnetron tube 38 is attached to an open end in the boiler 22 and is powered via electrical leads 39. Threaded nut 40 provides the means whereby the magnetron tube is so attached. The magnetron tube 38 will operate on frequencies ranging from 22,125 megaHertz down to as low as 915 megaHertz. The frequency is adjusted by means of the tuning bar 42. The emitter portion 44 of the magnetron tube 38 is protected from the contents of the chamber 26 by means of PYREX glass 46.

Situated about the stainless steel lining 28 is a steel wire grid 48. The grid 48 is connected to electrical leads 50 and when charged with electricity radiates heat to the interior of chamber 26 to maintain the contents of chamber 26 above a minimum temperature. This minimum temperature should be close to but below the boiling temperature of whatever fluid is being utilized in the system. The purpose of grid 48 is to maintain the fluid within chamber 26 near its boiling temperature so that when radiated by frequency generated by the magnetron tube 38, preheat time is substantially eliminated.

The fluid, after having been radiated into the agitated, expanded state by microwave frequency generated by the magnetron 38 will exit the boiler 22 by means of outlet 52 and will be directed via pipe 14 to throttle 54. The throttle 54 may be of any conventional type throttle commonly used with refrigerant type fluids, capable of providing precise regulation of the flow of fluid therethrough. Preferably, the throttle is a pedal-type constricter valve operated manually and/or electrically. The throttle will control the flow of fluid from the chamber 26. This flow may be electrically controlled via the throttle 54 by the computer. Next in line as shown in FIG. 1 is a diverter 56. The diverter 56, which may be electrically controlled by the computer, diverts and directs the flow of fluid to and between the two stages of the turbine wheel 58. The diverter 56 provides a Y-coupling whereby the flow of fluid from throttle 54 may be separated into two distinct but equal flows through passages 64 and 66. The diverter 56 is provided with a rotatable gate 60 which may be moved through an infinity of positions to either completely close the flow through one of the separated passages 64 or 66 or to apportion the flow between the two passages. A venturi 62 is provided in each of the flow passages 64 and 66 to impart additional speed to the fluid passing therethrough. The gate 60 is electrically actuated by a standard 12 volt solenoid and may be controlled manually or by the central computer. A bleed hole 68 is provided in gate 60 to eliminate problems due to back pressure and vacuum.

Figure 3:
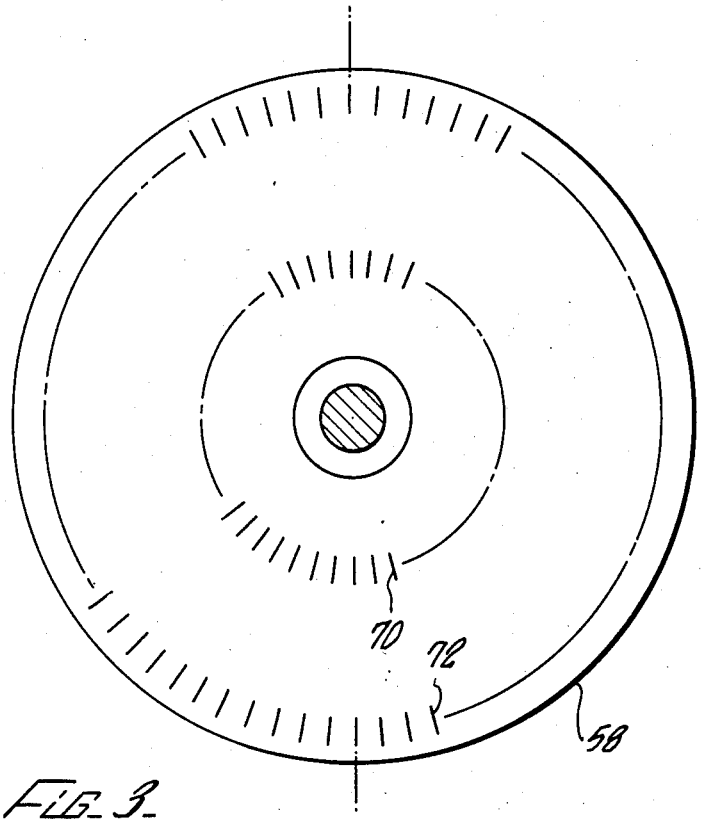
FIG. 3 is a side view of the two stage turbine wheel showing the two sets of vanes.
Figure 4:
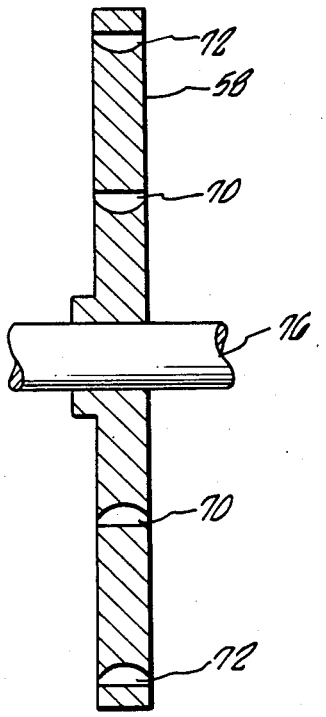
FIG. 4 is a side view, in cross-section, of the turbine wheel also showing the two sets of vanes.

Turning now to FIGS. 3 and 4, the turbine wheel 58 is shown in greater detail. The turbine wheel 58 has a first set of radial vanes 70 which are located near the center point of the turbine wheel 58. A second set of radial vanes 72 is located near the exterior circumference of the turbine wheel 58. The diverter 56 acts to apportion the flow of fluid between the first and second stage vanes 70 and 72. This will allow for further control of the RPM speed of the turbine. It will also provide for a greater acceleration at varying speeds.

Turning again to FIG. 1, the turbine wheel 58 is rotatably housed in block 74. The turbine wheel 58 is attached to rod 76, extending through the center of turbine 58. The rod 76, which rotates upon rotation of the turbine wheel 58, may be attached by any conventional linkage means to provide and transmit motive power for any desired purpose. In addition, the rod 76, as shown in FIG. 1, is attached by means of pulleys 78 and belts 80 to an A/C current generator 82 and a D/C generator 84. The electricity generated thereby will be used to aid in the continued operation of the system.

The fluid which has entered the block 74 will exhaust therefrom via exhaust ports 86 and 88 which are similarly aligned with the first stage vanes 70 and second stage vanes 72 of the turbine wheel 58. Immediately upon exhaust, the fluid is again reunited in a single transmission pipe 14 and is transmitted to a surge tank 90. Surge tank 90 is connected to the release valve 30 in boiler 22 such that in the event an excess of fluid pressure is created in chamber 26, the excess fluid will be released into surge tank 90, thereby eliminating the pollution of the environment. From the surge tank 90, the fluid is communicated to a condensor 92 where any remaining heat in the fluid is dissipated, returning the fluid to its liquid state for return to the holding tank 10. The condensor 92, within certain operational ranges of the sytem, is not needed as the fluid is sufficiently cooled and returned to the liquid state before reaching the condensor 92. Another valve 94 provides another shut down point in the system. Check valve 96 precludes the backflow of fluid in the system from the holding tank 10. Pump 98, which is the same type as pump 20, aides in returning the fluid to the holding tank 10. Lastly, valve 100 provides a shutdown and bleed off function within the system.

Figure 5:
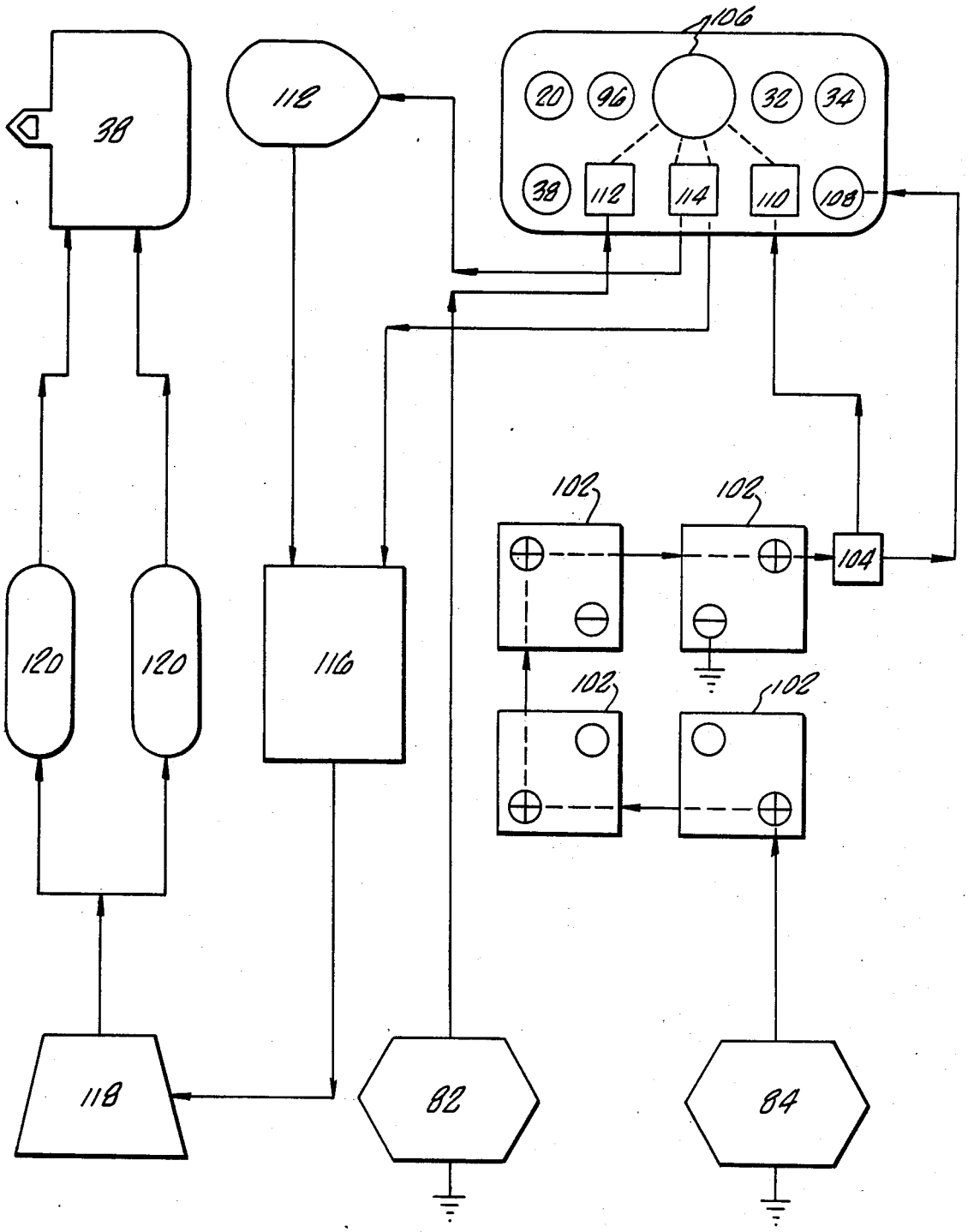
FIG. 5 is a schematic showing the electrical and control components of the system.
Figure 6:
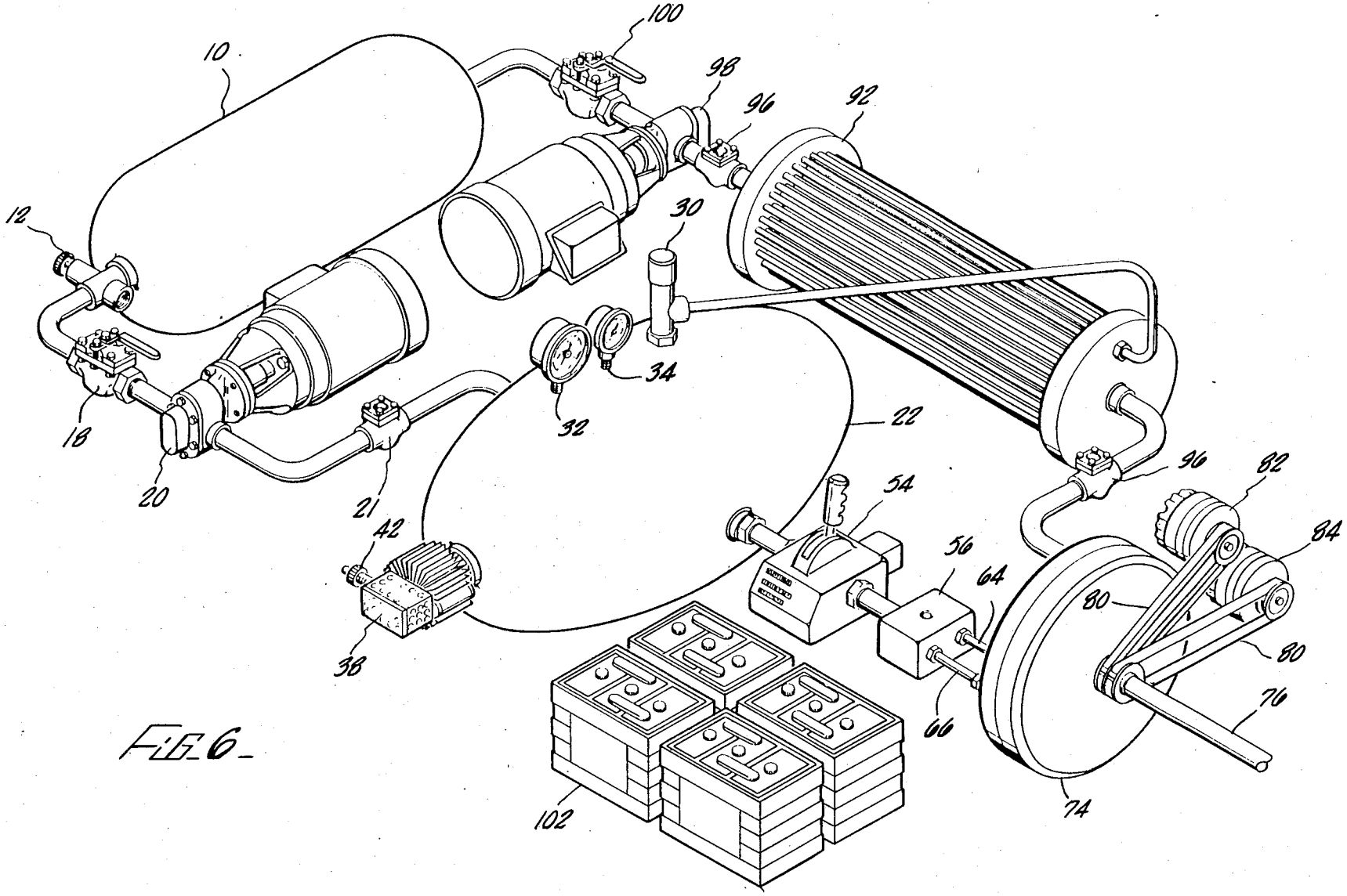
FIG. 6 is a perspective view of the major system components and their interrelationship.

Turning now to FIG. 5, one method of electrically charging the magnetron and controlling the system is shown. In FIG. 5, elements which have been previously shown and described are represented symbolically and accorded the same reference numerals as previously assigned thereto. Electrical power which is needed to start the system and to supplement power needs during the operation of the system is provided by batteries 102. The current from batteries 102 is fed through switch 104 to the computer 106. Switch 108, connected to switch 104, provides the on-off function for this system. Component 110 monitors the availability of D/C current. Component 112 monitors the availability of A/C current. When this system is in the on-mode, during start-up, the D/C current supplied by the batteries 102 is fed through a current relay gauge 11 to a transformer 116 where it is converted to A/C power, to a positive diode 118, from which the current is split to two twin capacitors 120 and from there fed to the magnetron 38. Once the system is in operation, the power to sustain operation will come substantially from the A/C generator 82. The computer 106 can be programmed to switch from the D/C to the A/C supply. The A/C current will be routed through the negative diode 122. The computer 106 can be programmed to monitor and control the various functions of the system to provide for optimum operation.

In operation, the fluid will be pumped from the holding tank 10 via pump 20 into the chamber 26. There, the fluid will be heated by means of microwave radiation generated by the magnetron 38. The heated fluid will be vented through throttle 54 to diverter 56. Depending upon the present speed of the turbine wheel 58, the diverter 56 will cause the flow of heated fluid to be apportioned between the first vanes 70 and the second vanes 72 of the turbine wheel 74. The heated fluid, impining upon the turbine wheel 58, will cause the turbine wheel to rotate, thereby rotating rod 76. This rotation of rod 76 may be captured and used as a source of motive power for any desirable purpose. The rotational movement of rod 76 will also be used to generate A/C and D/C current by means of A/C generator 82 and D/C generator 84. The fluid will be exhausted from the turbine wheel 58 and will be returned to its liquid state by means of condensor 92 and thence returned to holding tank 10 by means of the pump 98. Although the system may be operated entirely manually, it is preferred that the various functions of the system be monitored and controlled by a computer to insure optimum characteristics.

While embodiments and applications of the invention have been shown and disclosed, it would be apparent to those skilled in the art that many modifications are possible without departing from the inventive concepts herein described. The invention, therefore, is not restricted except by the spirit of the appended claims.

What is claimed is:

1. A power generation system wherein a fluid is heated by a microwave frequency to produce motive power, said system having:

(a) tank means for providing a reservoir for said fluid;

(b) boiler means, in fluid communication with said tank means, for heating said fluid, said boiler comprising a substantially elliptically shaped chamber having a longitudinal dimension twice its latitudinal dimension and having a stainless steel liner to which a heat grid is attached to the exterior thereof;

(c) means attached to said boiler for generating a microwave frequency and imparting same to said boiler to heat said fluid;

(d) means for converting energy of said heated fluid to motive power, said means in fluid communication with said boiler means;

(e) condensor means, in fluid communication with said energy conversion means, for cooling said fluid, said condensor means also in fluid communication with said tank means; and (f) control means for monitoring and controlling the flow and function of fluid throughout the system.

2. The system of claim 1 wherein said fluid is a refrigerant.

3. The system of claim 2 wherein said refrigerant is $CHClF_2$.

4. The system of claim 1 wherein said energy conversion means comprises a rotary turbine wheel.

5. The system of claim 4 wherein said turbine is a two-stage turbine, having two sets of radial vanes.

6. The system of claim 1 wherein said microwave generation means comprises a magnetron tube.

7. The system of claim 6 wherein said magnetron tube is capable of generating K-band frequency microwaves, in the range of 915 MegaHertz to 22,125 MegaHertz.

8. The system of claim 1 wherein said control means comprises a pressure pump means between said tank means and said boiler means for controlling and monitoring the flow of fluid from said tank means to said boiler means.

9. The system of claim 8 wherein said control means further comprises throttle means between said boiler means and said converter means for controlling and monitoring the flow of fluid from said boiler means to said converter means.

10. The system of claim 9 wherein said control means further comprises means for sensing the pressure and temperature of the fluid within said boiler means.

11. The system of claim 10 wherein said control means further comprises computer means for receiving and assimilating information input from said pump means, said throttle means and said pressure and temperature sensing means, and for controlling the function of said pump means, said microwave generation means, and said throttle means.

* * * * *